United States Patent [19]

Bruce et al.

[11] 4,118,941

[45] Oct. 10, 1978

[54] STRESSED CAISSON RETAINED ISLAND

[75] Inventors: John C. Bruce, Thornhill; John F. Davies; Jacobus J. A. de Jong, both of Calgary; Kalju Pullerits, Western Toronto; Richard H. B. Sangster, Calgary, all of Canada

[73] Assignee: Exxon Production Research Company, Houston, Tex.

[21] Appl. No.: 796,927

[22] Filed: May 16, 1977

[51] Int. Cl.[2] ..... E02B 27/30

[52] U.S. Cl. ..... 405/204; 405/207; 405/211

[58] Field of Search ..... 61/87, 96, 86, 50, 49; 52/248

[56] References Cited

U.S. PATENT DOCUMENTS

| | | | |
|---|---|---|---|
| 2,939,290 | 6/1960 | Crake | 61/87 |
| 3,538,710 | 11/1970 | Tourmen | 61/49 X |
| 3,618,327 | 11/1971 | Frein et al. | 61/96 |
| 3,648,303 | 3/1972 | Stewart | 52/248 X |
| 3,738,114 | 6/1973 | Bishop | 61/87 |
| 3,869,530 | 3/1975 | Williams | 52/248 X |
| 4,048,943 | 9/1977 | Gerwick, Jr. | 61/103 |

*Primary Examiner*—Jacob Shapiro
*Attorney, Agent, or Firm*—Michael A. Nametz

[57] ABSTRACT

Apparatus for constructing an island in a body of water including a plurality of caissons and means for connecting the caissons in an end-to-end configuration to form a ring. Once the caissons have been connected together to form a ring and ballasted to set the caissons upon the bottom of the body of water, sufficient fill material is placed inside the ring of caissons to construct an island in the body of water.

9 Claims, 5 Drawing Figures

STRESSED CAISSON RETAINED ISLAND

BACKGROUND OF THE INVENTION

1. Field of the Invention

This invention pertains to a retaining structure of caissons for use in building islands in bodies of water. More specifically, the invention pertains to a stressed caisson retaining system for building an island structure for use as an oil or gas well drilling and production platform in Arctic waters subject to impingement by ice formations.

2. Description of the Prior Art

In the shallow water Arctic regions off the northern coasts of Alaska and Canada, man-made islands have been proposed for use in supporting oil and gas exploration and production facilities. In fact, a number of islands have been built in the Beaufort Sea and exploration wells have been drilled from those islands. Most of those islands were built from fill material placed on the bottom of the body of water. The islands generally have gradually sloping beaches for erosion protection. Large amounts of fill are needed to build islands in this manner. The amounts of fill material and the costs of the islands increases dramatically with small increases in the water depth. Additionally, in many areas of the Arctic, fill material is not readily accessible and must be transported great distances to the island construction site again causing the cost of the island to increase dramatically with the amount of fill material needed.

It has been proposed to use conventional sheet pile enclosures or even a prefabricated cylindrical retaining wall to give the island a more cylindrical shape and thereby reduce the amount of fill material needed. Islands retained by sheet pile enclosures have definite limitations in Arctic applications. The greatest problem with a sheet pile enclosed island is in its foundation. The sheet pile foundation is extremely susceptible to slide failures as a result of the high differential loading of the sea bed inside the sheet pile enclosure compared to outside the enclosure. This means that the lower ends of the sheet piles would be subjected to great forces tending to move those lower ends outward from the island. Additionally, a great deal of time and equipment is needed to drive the sheet piles. In the Arctic, the open water period for offshore construction can be extremely short and seldom exceeds 80 days.

The prefabricated cylindrical retaining wall concept utilizes a large unitary tank member. It would normally require a diameter on the order of 300 feet. Transportation of the tank unit to the Arctic region would present a formidable problem. Even moving the tank from one exploration drilling site in the Arctic to the next drilling site could be difficult. Perhaps its biggest drawback, however, is that the continuous horizontal loads imposed upon the island by ice formations could in time deform the tank member since the fill material retained within the tank will deform slightly with time, leaving only the tank itself to resist the horizontal load. This lack of flexibility in the retaining structure would conceivably result in frequent damage to the tank.

Therefore, there exists a need for a portable retaining structure which can rapidly be assembled and is capable of withstanding the great forces imposed upon it by ice sheets during winter and by wave action during the open water period.

SUMMARY OF THE INVENTION

Briefly, this invention comprises a plurality of portable, floatable caissons and means for connecting the caissons in an end-to-end configuration to form a ring. Each caisson will be adapted to be set upon the bottom of the body of water and the ring of connected caissons will be capable of containing an amount of fill material sufficient to construct an island in the body of water.

The caissons can be connected together to form a ring either at the island construction site or at a staging area and towed from the staging area as a ring-unit to the island construction site. The caissons can then be ballasted to set them on a prepared site on the bottom of the body of water. It will be desirable for the caissons to have a height such that when set on the bottom of the body of water at the prepared site, the caissons will extend upward at least to the surface of the body of water, and preferably upward beyond the surface of the body of water to the desired freeboard.

Utilizing a number of caissons to form the retaining ring overcomes the transportation problems encountered with a solid unitary tank structure and since only a few caissons would be needed, the construction period required to install the caisson ring is kept to a minimum, especially if the ring is preassembled in a sheltered area prior to being set down at the island construction site.

Connecting the individual caissons in a ring effectively anchors the caissons against the outwardly directed active soil pressures exerted by the contained fill material as well as resisting the lateral loadings of ice formations with the mass of the entire island. Preferably, the connecting means will allow some flexibility in the caisson ring by allowing the individual caissons to move slightly relative to adjacent caissons in response to ice sheet loading or shifts in the fill material of the island or the berm upon which the caissons are set.

Preferably, the flexibility in the connecting means can be controlled to assist in removing the caisson ring when the island is abandoned. Once the caisson ring is ready to be lifted off the bottom of the body of water, the connecting means can be relaxed to allow the active soil pressure of the retained mass of fill material to dissipate itself by moving the caissons outward. When these active soil pressures dissipate to passive pressure, the caissons will lift themselves upward much easier.

It can be seen that the present invention has many advantages over previous methods and apparatus used to construct islands, especially in Arctic regions.

DESCRIPTION OF THE PREFERRED EMBODIMENTS

Figure 1:
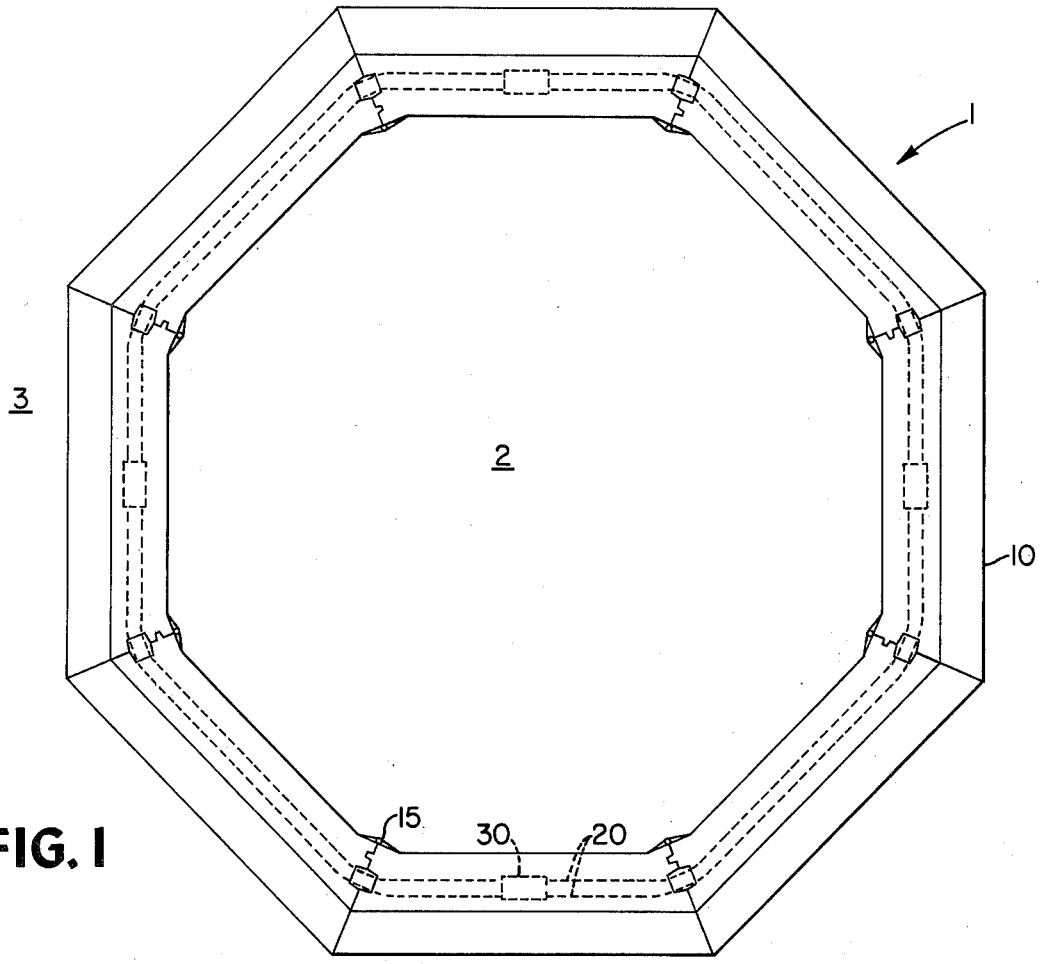
FIG. 1 is a top view of an island constructed in a body of water with apparatus of the present invention.
Figure 2:
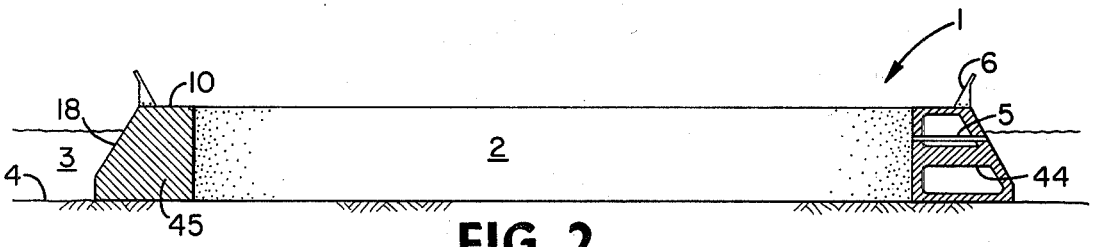
FIG. 2 is an elevation view in cross-section of the same island depicted in FIG. 1.

FIGS. 1 and 2 depict a stressed caisson retained island 1 in, respectively, a top view and a cross-sectional elevation view. The retaining structure is formed by a plurality of individual caissons 10 conneted in a configuration to form a ring. The caissons 10 of the preferred embodiment of this invention are designed for use in the shallow water regions off the northern coasts of Canada and Alaska and hence are constructed of steel. Of course, the caissons 10 could be constructed of concrete but the use of steel will generally enable the caissons 10 to have a greater reserve of buoyancy. Therefore, the steel caissons will have a smaller draft providing greater maneuverability in very shallow water areas and the extra buoyancy will make the steel caissons that much easier to raise from the bottom of the body of water in case the caissons are stuck when the island is abandoned.

It will be desirable for the caissons to have a height such that when set on the bottom of the body of water at the prepared site, the caissons will extend upward at least to the surface of the body of water and preferably upward beyond the surface of the body of water to at least the desired freeboard.

The outside surface 18 of the caissons 10 will preferably be slanted to deflect any impinging ice formations. The slanted outside surface 18 will force the ice formations to bend as they move against the caissons 10 to fail the ice formations in flexure. This will effectively decrease the horizontal loads of the ice formations on the island.

Within each caisson there are numerous web frames 44, girders and stringers designed to reinforce the caisson. Additionally, there are bulkheads 45 used to isolate various sections within each caisson. The various isolated compartments are used to separate such items as ballast, electrical generation equipment, fuel, hydraulic pumps and cable stressing equipment.

Stressing cables 20 extend longitudinally through each caisson 10 and are connected to stressing cables in adjacent caissons 10 at the joint to connect adjacent caissons. There is a stressing compartment 30 in alternate caissons 10 which contains a hydraulic jacking system to tension the stressing cables so that the caissons form a continuous stressed band. The connected and stressed ring of caissons 10 is designed to sit upon the bottom of a body of water and retain a mass of fill material 2, such as gravel, sand, or silt, which will form an island in the surrounding body of water 3.

Connecting hinges 15 are provided to temporarily connect adjacent caissons during transport or storage of the caissons. The caissons can be transported in pairs, or larger groupings. The connecting hinges 15 are also used for gross alignment of the caissons when the stressing cables of adjacent caissons are to be connected.

Two additional features are depicted in FIG. 2. At selected locations about the ring of caissons, a drain pipe 5 is provided to drain the water from within the caisson ring when the ring is filled hydraulically. The second feature is a deflector 6 positioned on top of the caissons 10 to deflect broken pieces of impinging ice formations back onto the ice sheets and away from the top of the island as well as to deflect incoming waves to protect the island. Since this deflector 6 runs the entire periphery of the caisson ring, it is preferable to provide emergency escape hatches through the deflector at numerous locations in case an emergency necessitates the personnel quickly leaving the island. Also, loading ramps could be provided which would fold down onto barges or ships which pull alongside the island to unload supplies or equipment.

Figure 3:
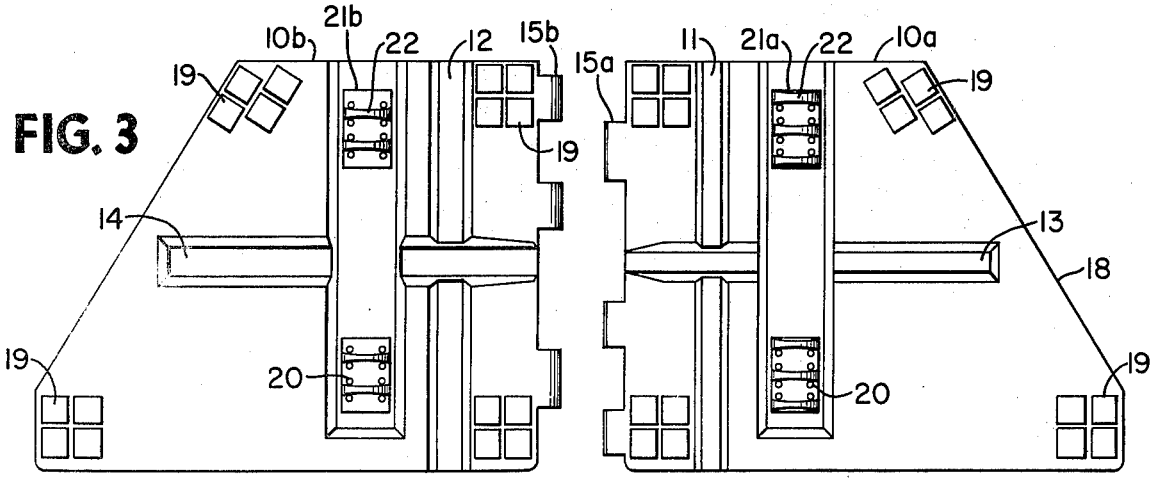
FIG. 3 is an end elevation view of two caissons that will be butted against each other when the two caissons are connected together.

FIG. 3 is an end elevation view of two caissons 10*a* and 10*b* which will butt against each other when the caissons are connected together. The two halves, 15*a* and 15*b*, of the temporary connecting hinge 15 are adapted to temporarily connect caissons 10*a* and 10*b* when a hinge pin is inserted through the hinge halves 15*a* and 15*b*. There is a considerable amount of play allowed in the temporary connecting hinge 15, since the hinge 15 merely serves as a temporary means of connection during transportation and storage of the caissons 10 and provides only gross alignment of adjacent caissons during assembly of the caisson ring. Final alignment is accomplished by the meshing of a horizontal key 13 and a vertical key 11 in caisson 10*a* with a horizontal keyway 14 and a vertical keyway 12 in the adjacent caisson 10*b*. But even these meshing keys and keyways are designed to allow a certain amount of movement between adjacent caissons.

When the two caissons 10*a* and 10*b* are pivoted about the temporary hinge 15 to be connected together, rubber bearing pads 19 on caissons 10*a* and 10*b* will actually be the only points of contact between caissons 10*a* and 10*b*, other than the keys. The use of rubber bearing pads 19 of a designed elasticity controls the flexibility at the joints as well as prevents adjacent caissons from damaging each other as they move relative to each other.

In the depicted embodiment, the stressing cables 20 run the entire length of each caisson 10 in two groups of 8 cables each. The stressing cables 20 in caissons 10*a* and 10*b* protrude through the end walls of the caissons 10*a* and 10*b* and are attached to two connecting heads 21. Each connecting head 21*a*, connected to the stressing cables 20 of caisson 10*a*, has three horizontally protruding links 22. There is a vertical hole in each link 22 and the holes in the links 22 of each connecting head 21*a* are vertically aligned. Each connecting head 21*b*, attached to the stressing cables 20 in caisson 10*b*, has two links 22. Each of these links 22 also has a vertical hole and the vertical holes in the links 22 of each connecting head 21*b* are vertically aligned. The connecting heads 21*a* and 21*b* and the links 22 on the connecting heads 21*a* and 21*b* are adapted in a manner such that the links 22 of connecting heads 21*a* and 21*b* are capable of being intermeshed when the caissons 10*a* and 10*b* are butted against each other. When the links 22 of connecting heads 21*a* and 21*b* are intermeshed, the vertical holes in all links 22 should be aligned so that a spud can be inserted through the holes in all the links 22 of both upper and lower sets of connecting heads.

The connecting spud will connect the connecting heads so that they cannot be pulled apart by tensile forces in the cables. This will thereby connect the stressing cables of the adjacent caissons at the joint. This means of connecting the stressing cables in adjacent caissons allows all stressing cables to be permanently installed within the caissons during fabrication of the caissons.

Figure 4:
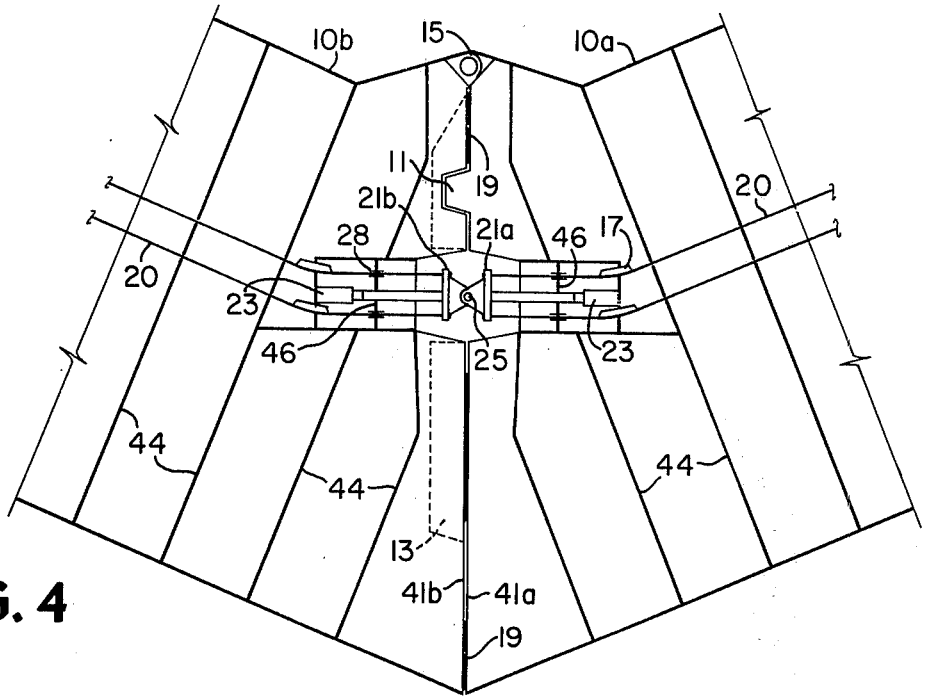
FIG. 4 is a top view in section of the end portions of two adjacent caissons connected together.

In FIG. 4, the details of a joint between two adjacent caissons 10*a* and 10*b* are shown in a top view of the joint in section. Some of the reinforcing web frames 44 can be seen. The end walls 41*a* and 41*b* of adjacent caissons 10*a* and 10*b* are maintained in a spaced-apart relationship by the rubber bearing pads 19. The vertical key 11 and the vertical keyway 12 can also be seen. It should be noted that a certain amount of play remains between the vertical key 11 and the vertical keyway 12 to allow the caissons 10*a* and 10*b* to move relative to each other. The horizontal key 13 is hidden from view in this figure.

The stressing cables 20 in each caisson 10 pass through the web frames 44 and around deflection channels 17 near the ends of each caisson 10 to redirect the stressing cables 20. When the stressing cables 20 pass through stuffing boxes 28 in the bulkheads 46 and through the caisson end walls 41*a* and 41*b* and emerge from caissons 10*a* and 10*b*, they should be parallel to each other.

As previously noted, the ends of the stressing cables 20 emerge from the ends of each caisson 10 and are connected to connecting heads 21. Adjacent caissons are connected by connecting the connecting heads 21 of adjacent caissons. This connection is made by a connecting spud 25 which is lowered into position from the top of the caissons. The connecting spud 25 can be a round shaft of steel adapted to be inserted into the vertical holes in the links of the connecting heads 21.

Preferably, the holes would be triangular as depicted in FIG. 4. Triangular-shaped holes will make it easy to install the connecting spud 25 and, when tension is applied to the stressing cables, the sides of the triangular-shaped holes will guide the connecting spud to the bearing areas at the apexes of the triangular holes. The apexes of the triangular-shaped holes can be adapted, in view of the shape of the connecting spud, to provide a well-fitting bearing surface for the connecting spud.

It should be noted that the connecting spuds should be provided with a large stopping head on the upper ends of the spuds to prevent the spuds from falling completely through the vertical holes in the links of the connecting heads.

To align the holes in the links of the connecting heads of adjacent caissons so that the connecting spud can be inserted through the holes, it may be necessary to move one or both of the connecting heads horizontally. A temporary hydraulic jack 23 can be provided to move each of the connecting heads 21 horizontally. Once the connecting heads 21 have been properly positioned and connected with the connecting spud 25, the temporary hydraulic jacks 23 can be removed.

While there are other ways to connect a plurality of caissons to form a stressed band, the use of stressing cables running the entire circumference of the caisson ring allows good flexibility between the caissons at the joints. This is because adjacent caissons are in effect connected by a length of stressing cable running from the mid-point of one caisson through the joint between adjacent caissons and ending at the mid-point in the adjacent caisson. Therefore, any stretch in the stressing cables over that entire distance will allow the same amount of longitudinal movement of adjacent caissons at the joint. Naturally, the greater the modulus of elasticity of the material used to make the stressing cables, the greater the flexibility at the joints will be.

It can also be noted in FIG. 4 that there is a small gap between adjacent caissons 10*a* and 10*b*. To prevent the fill material used to form the island within the caisson ring from slowly leaking out these gaps, between adjacent caissons, some type of gap-plugging means should be used. This can be accomplished by a stack of sandbags placed vertically along the gap on the inside corner of adjacent caissons where the temporary hinges are located. Also, rubber sheets or plastic could cover the gap where the temporary hinges are located and would be held in place by the fill material confined within the caisson ring.

Figure 5:
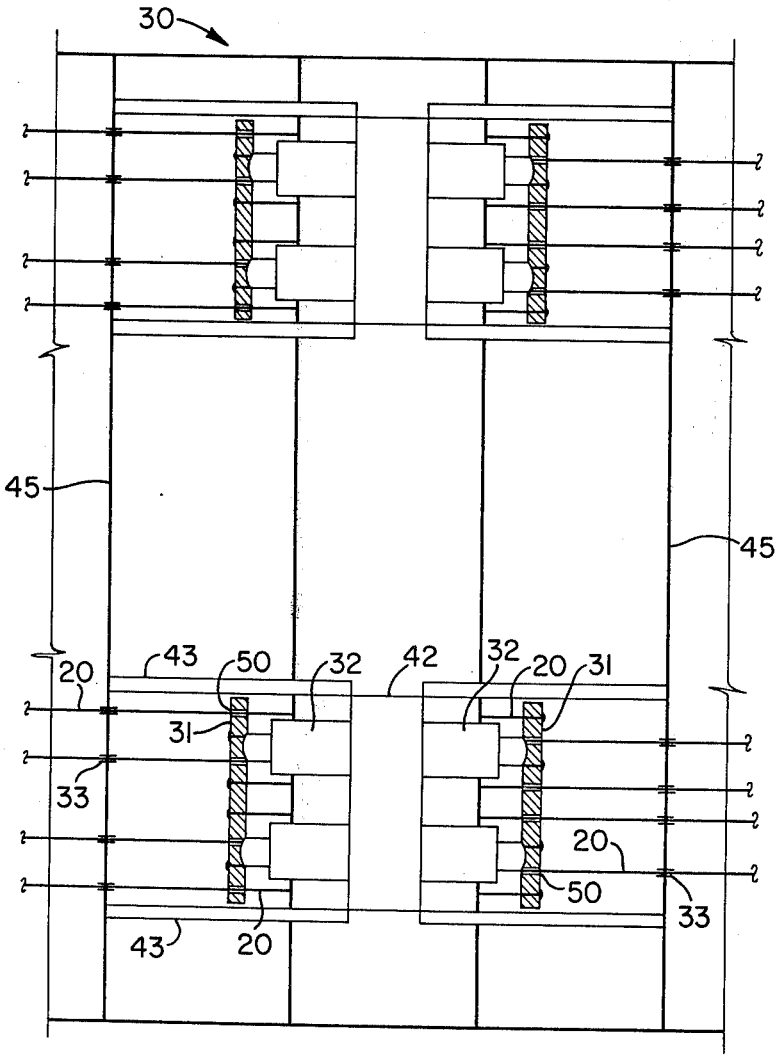
FIG. 5 is an elevation view in cross-section of a stressing compartment located within selected caissons and designed to stress the cables running circumferentially through the connected ring of caissons.

A cross-sectional elevation view of a stressing compartment 30 is depicted in FIG. 5. An island formed by eight caisson sections, as depicted in FIG. 1, would preferably have four stressing compartments 30 located in every other caisson 10. Within each stressing compartment 30, there is provided a means for tensioning the stressing cables 20. In the center of the stressing compartment 30 for each group of stressing cables, there is a vertical strongback 42. Moveable stressing heads 31 are located on each side of the strongbacks 42. The stressing heads 31 are adapted to move horizontally within the horizontal guides 43. All of the stressing cables 20 cross over and pass through the strongbacks 42. Each stressing cable 20 enters the stressing compartment 30 through a stuffing box 33 in bulkhead 45. Each cable 20 passes through a hole 50 in the first stressing head 31 and then through a hole in the strongback 42. Each stressing cable 20 is then connected to the second stressing head 31, that is the stressing head 31 on the opposite side of the strongback 42 from which the stressing cable entered the stressing compartment 30. Hydraulic jacks 32 are provided on both sides of the strongback 42 which are capable of expanding against the strongback 42 to move the stressing heads 31 away from the strongback 42 to tension the stressing cables 20.

The pressurized hydraulic fluid needed to operate the hydraulic jacks can be provided by a hydraulic fluid pumping system located within the caissons 10. The electricity needed to run the hydraulic pumps can be provided by an electrical generation system also located within the caissons.

Once constructed, the individual caissons must be transported to the site where the island is to be constructed, or preferably a staging area near by. The caissons 10 can be barged or floated in any number of ways. They can be towed as a long chain, towed individually, or in pairs, and can even be towed four at a time when connected in a rhombic shape.

Once at the assembly site, the individual caissons 10 are connected together. As described earlier, the temporary hinges are used to provide a gross alignment. As two adjacent caissons are pivoted about their hinge, the vertical and horizontal keys mesh to provide a final alignment of the caissons. The caissons can be pivoted about the temporary hinge through the use of tugboats or even winches mounted on the caissons. Once the ends of the caissons are in contact, the stressing cables are connected by connecting spuds being lowered from the top of the caissons to rigidly connect the connecting heads of adjacent caissons. Once a slight amount of tension is applied and maintained on the stressing cables, the hinge pin of the temporary connecting hinge should be removed.

After all of the caissons have been connected to form a ring, the cables should be tensioned to a predetermined stress before the retaining structure is towed to the island site and set on the bottom of the body of water. Prior to the caisson ring being set in place, the bottom of the body of water should be leveled out at a depth not more than the maximum water depth for which the caissons have been designed. If the water depth at the proposed location exceeds the maximum depth, a berm of appropriate fill material must be constructed and leveled so that the water depth does not exceed the maximum allowable water depth for the caissons. The apparatus of the present invention will tolerate a certain amount of unevenness due to the designed play in the joints which allows the individual caissons to move slightly in all three planes. In certain locations, it may be advisable, even if the water depth is less than the maximum allowable water depth for the caissons, to construct a berm if the original bottom material would make a very poor foundation. Preferably, a berm should be constructed some time in advance of the time when the island is built to allow for consolidation of the foundation.

When the island has been properly positioned over the prepared site, the caissons can be ballasted with either a dense material, such as sand, or, preferably, with water to lower the caisson ring to the bottom of the body of water. Filling of the interior of the caisson ring can then begin. The fill material from which the island is to be made is placed inside the caisson ring by any convenient method. Sand, silt, or gravel could be used.

The tension in the stressing cables may be reduced after the caisson ring is filled and after the fill material within the caisson ring has frozen. This will allow movement in all three planes between adjacent caissons in response to settlement of the fill or foundation or to extreme loadings, as are occasionally caused by ice formations moving against the caisson ring. Even if the fill material were to deform under these pressures, the individual caissons would move to compensate accordingly. Therefore, the horizontal loadings of ice formations will be resisted by the entire mass of the caissons and the retained fill material.

Once the island is in place, steps should be taken to prevent erosion around the toe of the caissons. The stressed caissons of the present invention are capable of limited movement so a minor amount of erosion could be coped with by the structure. Significant erosion should be prevented since it could threaten the integrity of the island. One way erosion protection can be accomplished is by placing a filter layer of sand, gravel and rock of the appropriate sizes on top of the berm around the toe.

Once the island is to be abandoned, it is possible to raise the caissons as a complete ring unit by deballasting the caissons. The steel caissons will have reserve buoyancy considerably in excess of that required to lift themselves in spite of the active soil pressure of the retained fill material and the keyed ends of the caissons will assist in removing adjacent caissons that are stuck or even damaged and flooded.

The preferred procedure for raising the caisson ring begins with the step of thawing the water ballast within the caissons. This can be accomplished by installing electrical resistance-heating elements within the caissons. Electrical current can be supplied to the resistance-heating elements to melt the ballast by the electrical generation system within the caisson ring. Once the ballast has been melted, sufficient ballast is pumped out of the caissons to make the caissons neutrally buoyant. The stressing cables are relaxed so that any active soil pressure in the retained island fill material can dissipate itself by moving the caissons outward to reduce the soil pressure to the passive state. Additional ballast is then pumped out of the caissons to raise the ring of caissons. The reserve buoyancy of steel caissons will generally be far in excess of the buoyancy needed to raise the caisson ring in spite of any active soil pressure of the retained fill material. However, if one so desires, the fill material can be removed from within the caisson ring before the caissons are raised.

Once the caisson ring is floating, the unretained mass of fill material used to construct the island will most likely prevent the caisson ring from being towed away as a unit. The caissons can be disconnected at the joints and towed away either in sections or individually to the next assembly site.

The principle of the invention and the best mode in which it is contemplated to apply that principle have been described. It is to be understood that the foregoing is illustrative only and that other means and techniques can be employed without departing from the true scope of the invention defined in the claims.

What is claimed is:

1. Apparatus for constructing an island in a body of water comprising:

a plurality of caissons adapted to be set upon the bottom of the body of water; and flexible means for connecting the caissons together to form a ring of connected caissons which is capable of containing an amount of fill material sufficient to construct an island in the body of water, said connecting means being sufficiently flexible so as to permit relative movement between said plurality of caissons in any direction and having controlled flexibility.

2. The apparatus of claim 1 further comprising a horizontal key on an end of a first caisson and a horizontal keyway on an end of a second caisson, the ends of the first and second caissons being those that will contact each other when the caissons are connected together, the key and keyway adapted to vertically align the caissons when the caissons are placed end-to-end to be connected.

3. The apparatus of claim 1 further comprising a vertical key on an end of a first caisson and a vertical keyway on an end of a second caisson, the ends of the first and second caissons being those that will contact each other when the caissons are connected together, the key and keyway adapted to horizontally align the caissons when the caissons are placed end-to-end to be connected.

4. Apparatus for constructing an island in a body of water comprising:

a plurality of caissons adapted to be set upon the bottom of the body of water; and flexible means for connecting the caissons together to form a ring of connected caissons which is capable of containing an amount of fill material sufficient to construct an island in the body of water, said connecting means being sufficiently flexible so as to permit relative movement between said plurality of caissons in any direction, said connecting means comprising (a) cable means extending circumferentially around the caisson ring within each caisson, said cable means comprising a cable extending longitudinally within each said caisson and means for connecting the ends of the cables of adjacent caissons; and (b) means for tensioning said cable means.

5. The apparatus of claim 4 wherein the means for connecting the ends of the cables of adjacent caissons comprises connecting heads connected to the ends of the cables, each connecting head having a connecting link projecting horizontally therefrom, each link having a hole extending vertically therethrough, the connecting heads of adjacent caissons being adapted and positioned so that the links of the connecting heads of adjacent caissons can be intermeshed and the holes in their links aligned, and a connecting spud adapted to be inserted through the aligned holes in the links of the connecting heads of adjacent caissons to connect the connecting heads.

6. An island constructed in a body of water comprising:

a plurality of caissons set upon the bottom of the body of water and having a height such that the caissons extend upward from the body of water at least to the surface of the body of water;

means for connecting the caissons in an end-to-end configuration to form a ring of connected caissons, said connecting means being flexible so as to permit relative movement between said plurality of caissons in any direction, said connecting means comprising (a) cable means run circumferentially around the caisson ring within the caissons, said cable means comprising a cable extending longitudinally within each caisson and means for connecting the ends of the cables of adjacent caissons; and (b) means for tensioning said cable means; and fill material placed within the ring of caissons in an amount sufficient to construct an island in the body of water.

7. The island of claim 6 further comprising means for plugging the gaps between adjacent caissons to prevent the fill material contained within the caisson ring from escaping through the gaps.

8. The island of claim 6 wherein said body of water contains ice formations and further comprising means positioned on top of said caissons for deflecting said ice formations.

9. The island of claim 6 wherein said body of water contains ice formations and said caissons have a slanted outer surface for deflecting said ice formations.

* * * * *